United States Patent [19]

Gerson et al.

[11] 4,059,037

[45] Nov. 22, 1977

[54] SLICING DEVICE

[75] Inventors: Samuel L. Gerson; Frank W. Jones, both of Wilmington, Del.

[73] Assignee: Fasline Food Equipment Co., Wilmington, Del.

[21] Appl. No.: 680,033

[22] Filed: Apr. 26, 1976

[51] Int. Cl.[2] ..... B26D 7/06

[52] U.S. Cl. ..... 83/407; 83/425.3; 83/437; 83/857

[58] Field of Search ..... 83/407, 425.1, 425.2, 83/425.3, 437, 856, 857

[56] References Cited

U.S. PATENT DOCUMENTS

| | | | |
|---|---|---|---|
| 236,178 | 1/1981 | Rice | 83/425.3 X |
| 982,366 | 1/1911 | Hungerford | 83/425.3 |
| 1,443,281 | 1/1923 | Schoenborn | 83/425.3 |
| 1,748,997 | 3/1930 | Rentos | 83/407 |
| 2,247,810 | 7/1941 | Healy | 83/407 |
| 2,487,431 | 11/1949 | Floyd | 83/857 |
| 2,495,770 | 1/1950 | Rivet | 83/437 |
| 2,572,770 | 10/1951 | Shadduck | 83/437 |
| 3,112,781 | 12/1963 | Popeil | 83/437 |
| 3,208,309 | 9/1965 | Popeil | 76/101 |
| 3,216,474 | 11/1965 | Popeil | 83/62 |
| 3,369,582 | 2/1968 | Giangiulio | 99/537 |
| 3,807,266 | 4/1974 | Camp | 83/425.3 X |
| 3,830,151 | 8/1974 | Gerson | 83/437 X |

*Primary Examiner*—Harrison L. Hinson
*Assistant Examiner*—Horace M. Culver
*Attorney, Agent, or Firm*—Connolly and Hutz

[57] ABSTRACT

Two racks of parallel thin sharp blades are intermeshed in a crossed disposition within the open interior of a rectangular base frame. A pusher having a concave pocket and spaced ribs for entering between the crossed blades is reciprocally mounted upon the sides of the base frame. An object to be sliced is forced by the pusher through the junctions of the crossed blades. An auxiliary cutting blade may be mounted below the junctions of the blades to cut the slices pushed through the blades into two portions.

14 Claims, 8 Drawing Figures

Fig. 5.
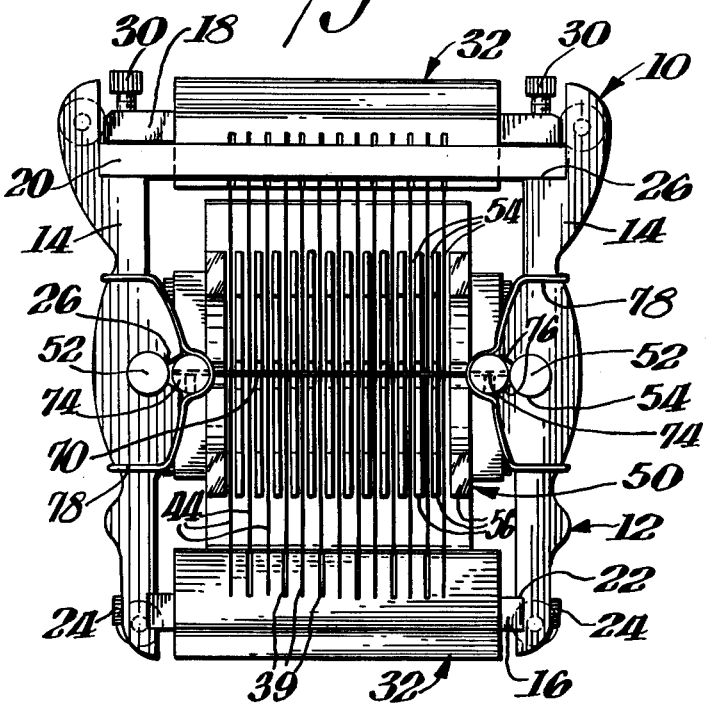
Fig. 8.
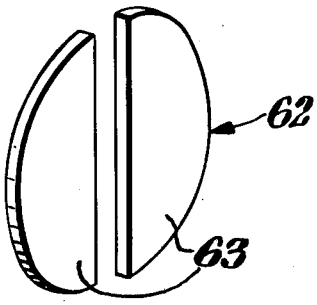
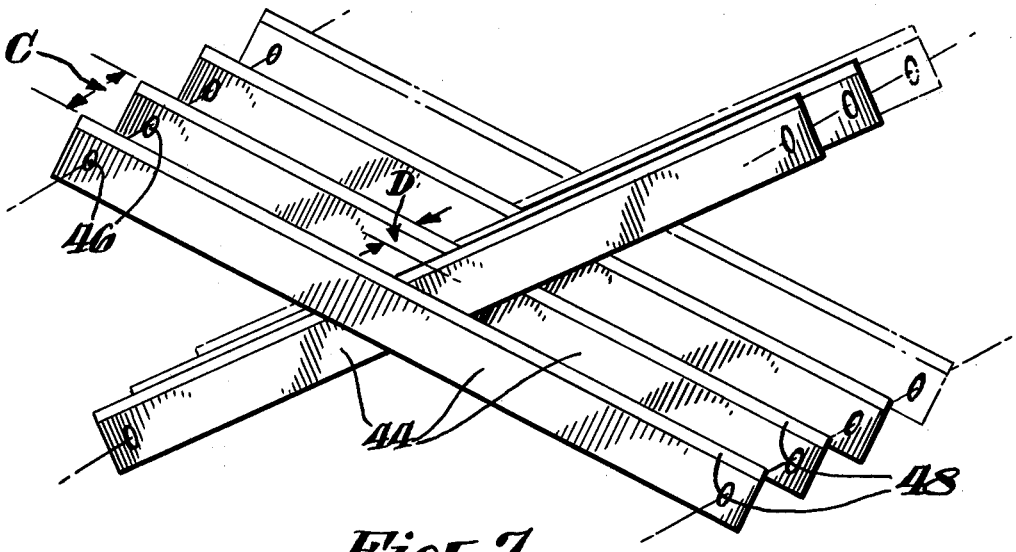
Fig. 7.

SLICING DEVICE

BACKGROUND OF THE INVENTION

Many devices exist for slicing fruits and vegetables including: tomatoes, onions, lemons, limes, and the like. Such devices usually incorporate racks of thin sharp blades and some form of slotted pusher for forcing the object through the blades. It is an object of this invention to slice a wide variety of objects in a single slicer. Other objects are to maintain the device as compact as possible, with blades shielded and as short as possible, simple, economical, rugged and durable.

SUMMARY

In accordance with this invention a pair of diagonally crossed alternately meshed racks of thin sharp blades are mounted within the open interior of a base frame. An object to be sliced is forced by a slotted pusher first through the more widely spaced extremities of the blades and then through the more narrowly spaced junctions of the crossed blades whereby initiation of slicing is facilitated and remarkably effective slicing action is ultimately achieved. The pusher may be reciprocally mounted with an axis of movement extending through the crossed blade junctions and has a concave pocket for urging the object towards the junctions of the crossed blades. An advantageous embodiment has a rectangular frame with end bars over which C-shaped blade supporting members are mounted. The blades extend between the upper arm of one C-shaped member and lower arm of the other racks are meshed with each other at a substantially uniform spacing. One of the mounting bars is adjustably mounted to tension the blades. An auxiliary blade may be mounted below the junctions of the crossed blades for cutting the obtained slices in two parts. The auxiliary blade may be mounted in extensions of slots in the side plates which slidably receive the rods, which guide movement of the pusher through the blades. The sides, ends, blades supports and pusher may have uniform cross sections to facilitate their fabrication by extrusion.

BRIEF DESCRIPTION OF THE DRAWINGS

Novel features and advantages of the present invention will become apparent to one skilled in the art from a reading of the following description in conjunction with the accompanying drawings wherein similar reference characters refer to similar parts and in which:

FIG. 5 is a bottom plan view of the slicing device shown in FIGS. 1-4;

FIG. 7 is a diagrammatic pictorial view of the blade arrangement utilized in the slicing device shown in FIGS. 1-6; and FIG. 8 is a diagrammatic view showing slices obtained from one configuration of the slicing device shown in FIGS. 1-7.

DESCRIPTION OF THE PREFERRED EMBODIMENT

Figure 3:
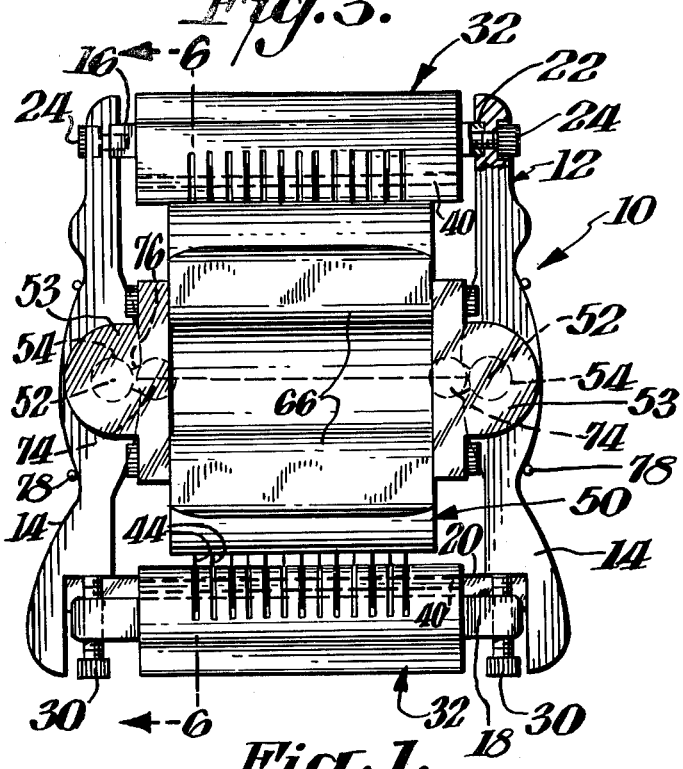
FIG. 3 is a top plan view of the slicing device shown in FIGS. 1 and 2.
Figure 4:
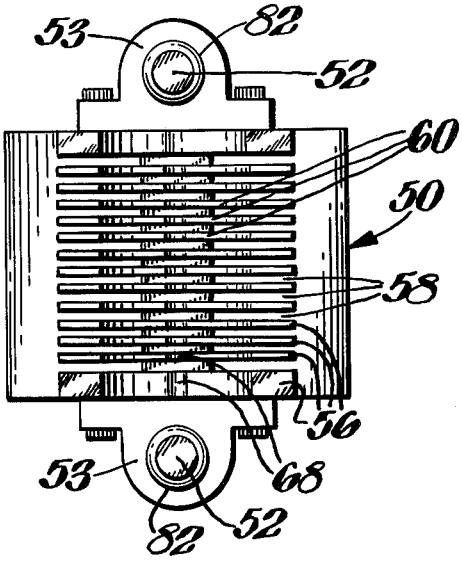
FIG. 4 is a top plan view of the slicing device shown in FIGS. 1-3 with the pusher removed.
Figure 1:
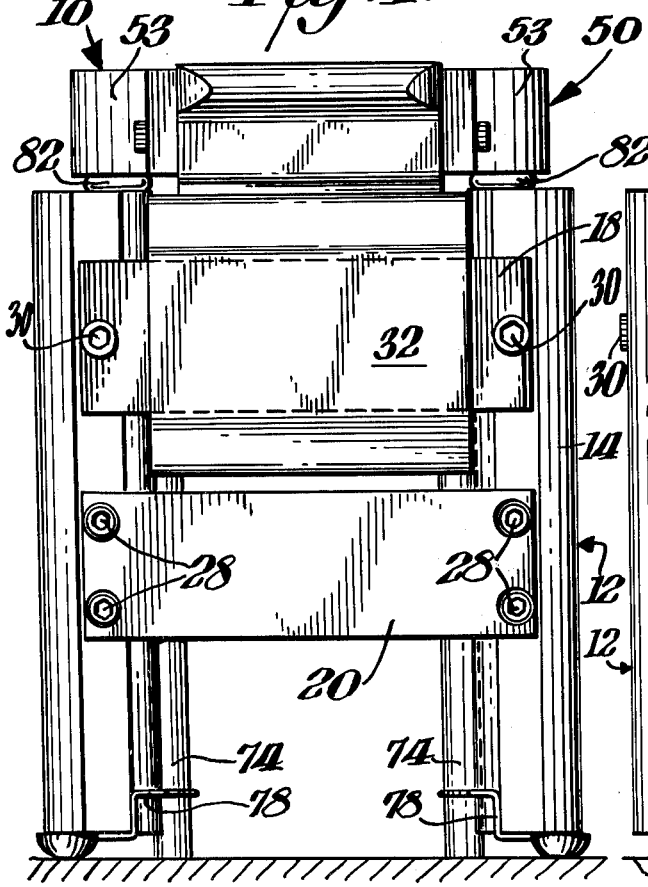
FIG. 1 is an end view in elevation of a slicing device which is one embodiment of this invention.
Figure 2:
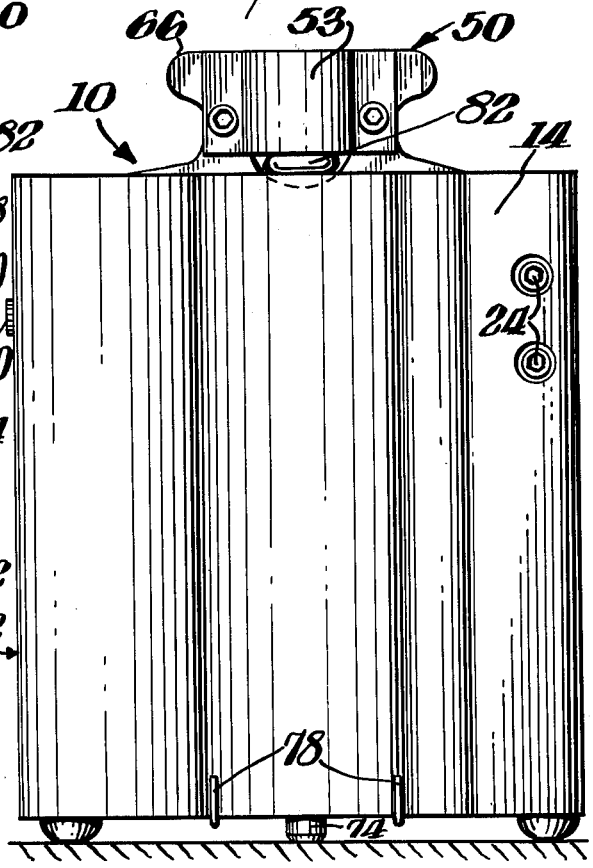
FIG. 2 is a side view in elevation of the slicing device shown in FIG. 1.

In FIGS. 1-7 is shown a slicing device 10 including a substantially rectangular base frame 12 having a pair of side plates 14 and end bars 16, 18 and 20. End bar 18 is more specifically a tension bar. End bar 16 is securely mounted across one end of side plates 14 by insertion in slots 22 and engagement by cap screws 24. Lower end bar 20 on the other end of base frame 12 is secured to shoulder 26 of side plate 14 by cap screws 28. Upper tension bar 18 is adjustably secured to shoulder 26 by cap screws 30, which are adjustable to move tension bar 18 towards and away from shoulder 26 for tensioning or removing blade assemblies. Side plates 14 have uniform cross-sections to facilitate fabrication by extrusion from an aluminum alloy. The other major parts of the device, with the exception of the blades, may also be fabricated from an aluminum alloy and also as extrusions except when they are merely bars or shafts.

Figure 6:
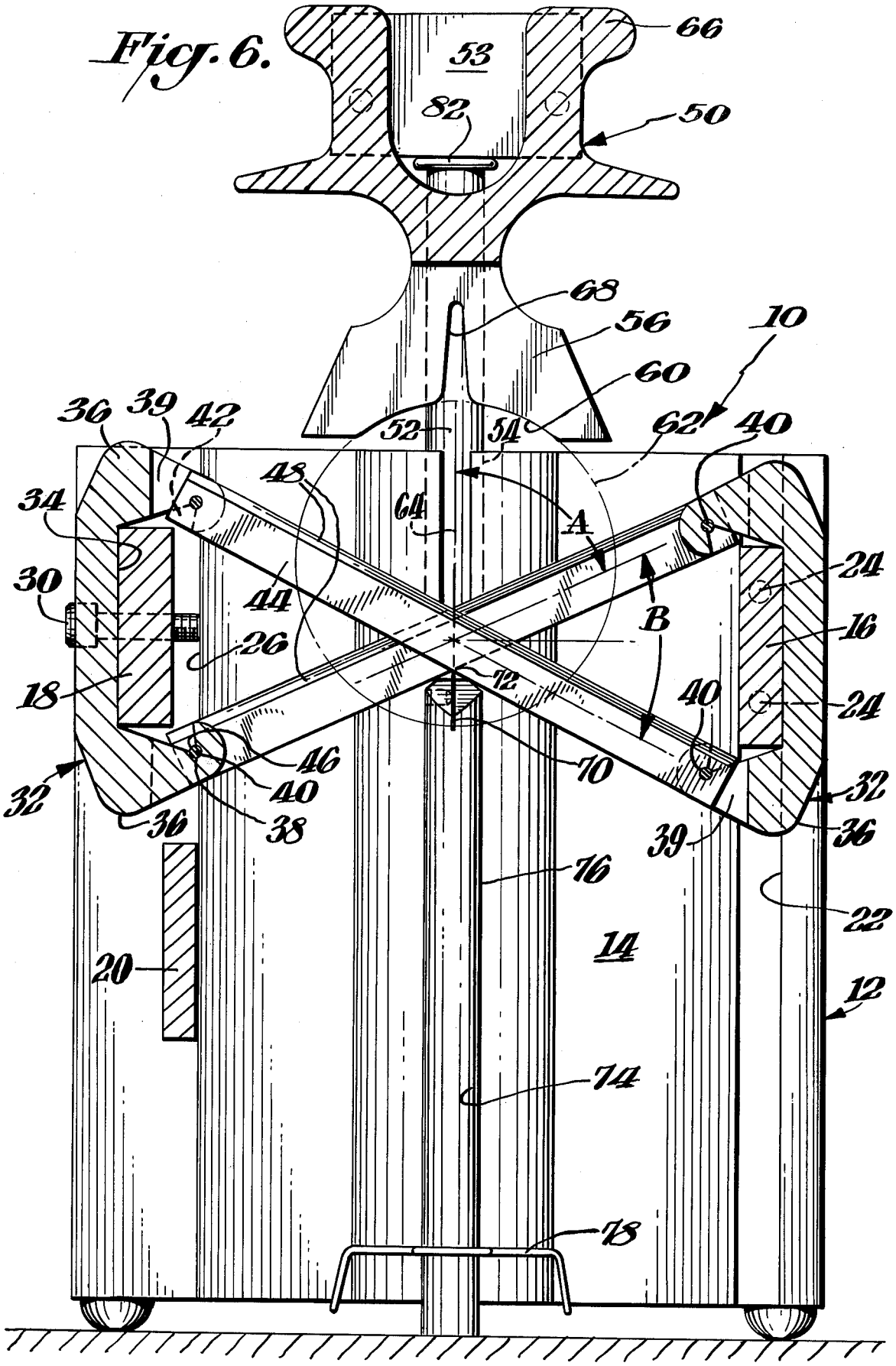
FIG. 6 is a cross-sectional view taken through FIG. 3 along the line 6—6.

FIG. 6 shows the disposition of C-shaped blade supports 32 about end bars 16 and tension bar 18 disposed against body portions 34. Upper and lower arms 36 of C-shaped members 32 include holes 38 through which blade mounting pins 40 are inserted. The angular throats 42 joining holes 38 are merely for facilitating extrusion of C-shaped members 32. Arms 36, slots 39 and pins 40 provide means for anchoring the ends of thin sharp blades 44 including holes 46. Pins 40 are removably inserted through holes 38 in arm 36 and blade holes 46 for removably connecting blades 44 to arms 36.

Blades 44 are made of a strong sharp steel with sharp upper edges 48. Blades 44 are advantageously made of "400" series stainless steel such as "410" stainless steel approximately 0.018 inches in thickness and one-half inch wide.

One rack of blades 44 is connected to the upper arm 36 at one side of base frame 12 and has its other ends connected to the lower arm 36 at the other end of base frame 12. The other row of blades is similarly mounted from the top of one arm to the bottom of the other arm opposite C-shaped blade support members 32. The blades of one arm 36 alternate or mesh with the blades connected to the other arm 36 of one C-shaped member 32 and cross each other with junctions approximately in the midportion of the interior space within box frame 12. Off-center junctions are also contemplated for certain conditions. Movement of adjusting screws 30 pulls tension bar 18 away from bar 16 and also pushes one C-shaped member 32 away from the other to forcefully tension blades 44.

Pusher 50 is movably mounted relative to base frame 12 by parallel rods 52 connected to the pusher head by brackets 53. Rods 52 slidably engage in slots 54 in the mid-portion of side plates 14. Pusher 50 includes an array of flat spaced ribs 56 separated by slots 58. A concave pocket 60 is disposed in the bottom edges of ribs 56 for pushing an object 62, such as a tomato or onion shown in phantom outline, through the crossed junctions of blades 44. The illustrated spacing between the upper and lower ends of blades 44 provides an angle A between each of the blades and the axis 64 of movement of pusher 50 of approximately 65°, and a blade length of approximately 5½ inches or 14 cm. The angle B between the blades is approximately 50°. This disposition provides a remarkably effective slicing action, which is remarkably facilitated between cross junction of the alternating blades, which in some way unexpectedly improves the slicing action over that obtainable from a single set of diagonal blades. A useful range of angles A would extend from about 55° to 75° to the axis of movement 64 of pusher 50, but such angles could also be smaller or greater, depending upon space considerations and action desired.

Pusher 50, has a uniform cross section capable of extrusions includes an upper handle 66 and a longitudinal slot 68 in ribs 56 to provide clearance for an optional auxiliary blade 70 mounted below junctions 72 of blades 44 for cutting slices of an object 62 into two parts 63 (shown in FIG. 8) if such are desirable for example for lemons, limes or tomatoes. Blade 70 is mounted on a pair of auxiliary rods 74 removably mounted (as shown in FIG. 5) in angular extensions 76 of slots 54, which receive pusher rods 52. FIG. 5 shows spring clips 78 removably securing auxiliary blade mounting rods 74 against angular slot extensions 76.

Pusher 50 is shown in a position in which it is urging an object 62 through the crossed junctions of blades 44. Pusher 50 can be raised a considerable distance away from base frame 12 to permit an object 62 to be inserted by hand into junctions 80 between the sharp edges 48 or blades 44. An operator can safely prescore the skin of an object 62, such as a soft tomato while inserting it into junctions 80 by sliding it down one set of sharp edges 48. The upper extension of C-shaped member 32 above the blade array helpfully shields the hand and fingers of the operator from the sharp edges of the blades 44 and provides convenient handles for lifting, manipulating and transporting slicer 10. Elastomeric O-rings 82 about the upper ends of pusher rods 52 cushioning the downward movement of the pusher 50 against the upper edges of side plates 14.

Slicing device 10 is remarkably capable of slicing of wide variety of fruits and vegetables, including lemons, tomatoes and onions. It has heretofore only been possible to slice onions in a special slicer having a relatively stronger configuration and thicker blades than used for slicing softer objects, such as tomatoes. Slicing devices 10, however, is capable of dependably slicing onions without damage to the blades and can also advantageously slice tomatoes, even soft ones.

FIG. 7 shows the difference in spacing C between blades 44 at the unmeshed portions of blades 44 and the narrower spacing D at the junctions or meshed portions 80 of blades 44. Spacing C is, for example, approximately ⅜ inch or 10 mm. and spacing D is approximately 3/16 inch or 5 mm. This transition from wider to narrower spacing highly facilitates initial piercing of the object to be sliced, because the object must be pushed through less blades during the more difficult initial cutting phase. It is not until the object is substantially cut through between unmeshed portions of the blades that it is subjected to concerted cutting by all of the blades at junctions 80 of the blades in the mid portion of base frame 12. This transition remarkably facilitates cutting and the ultimate final slicing of the object.

We claim:

1. A slicing device comprising a pair of racks of substantially parallel sharp thin blades having a substantially uniform spacing for obtaining slices of predetermined thickness, the spacings in each rack being substantially twice the thickness of the ultimate slices obtained from the slicer, a base frame, the pair of racks being mounted on the base frame in an intermeshed configuration in which the racks cross each other at junctions at intermediate portions, the intermeshed spacing of the blades in the racks being substantially uniform and substantially half the spacing in each individual rack of blades in the extremities of the racks away from the crossed junctions, a pusher, movable means mounting the pusher on the base frame to provide movement of the pusher towards and away from the crossed racks of blades along an axis of movement, and the axis of movement going through the crossed junctions of the blades whereby an object is first contacted with the more widely spaced extremities of the blades disposed outside of the cross junctions and ultimately pushed through the cross junctions of the blades whereby initial cutting is facilitated by the contact with more widely spaced blades to facilitate initial cutting and the object is gradually introduced into the narrower spacing at the junctions of the blades to complete their slicing.

2. A slicing device as set forth in claim 1 wherein the racks of blades cross each other approximately at mid-portions.

3. A slicing device comprising a base frame having sides surrounding a substantially open interior space, a row of upper and lower blade anchors disposed on opposite sides of the base frame, rows of substantially parallel and equally spaced thin sharp blades connected between an upper row of blade anchors on one side of the base frame and a lower row of blade anchors on the other side of the base frame whereby the blades are disposed diagonally across the interior space and cross each other within the interior space, the blades in opposite rows alternately intermeshing with each other to have more widely spaced extremities and more narrowly spaced junctions, tensioning means reacting between the blade anchors and the base frame for pulling the blades taut, a pusher for urging objects to be sliced through the crossed array of blades, the pusher being slotted to have a plurality of thin ribs for entering between the blades, and movable connecting means mounting the pusher on the base frame whereby it may be moved from a position remote from the blades to a position in which ribs enter between the blades to push an object to be sliced first through the more widely spaced extremities and then through the more narrowly spaced junctions of the blades whereby initial cutting and final slicing of the objects are facilitated.

4. A slicing device as set forth in claim 1 wherein the base frame comprises a substantially rectangular array of side and end plates, the blade anchors and tensioning means being mounted on the end plates, and the movable connecting means comprising slide means connected over mid-portions of the side plates whereby the pusher is guided in a substantially longitudinal path of movement towards and away from the interior space within the base frame and crossed blades within it.

5. A slicing device as set forth in claim 4 wherein the blade anchors comprise a pair of C-shaped members each having a back and upper and lower arms, the C-shaped members being mounted on the end plates with their backs disposed against the end plates and upper and lower arms disposed above and below the end plates and extending towards the interior space within the base frame, and blade anchoring means being disposed in oppositely facing upper and lower arms of the C-shaped members.

6. A slicing device as set forth in claim 5 wherein the end plates comprise end bars, and one of the end bars is movably connected to the side plates for forceful adjustment away from the interior space whereby the blade tensioning means is provided.

7. A slicing device as set forth in claim 6 wherein a pair of end bars are provided on one end of the base frame, one of the end bars being rigidly connected across the side plates, adjustable screw means mounting the other end bar across the side plates whereby the movably mounted end bar may be forceably adjusted away from the interior space, and one of the C-shaped members being mounted about the movable end bar.

8. A slicing device as set forth in claim 7 wherein the movable connecting means comprises a pair of vertical slots in the mid-portions of the side plate and a pair of parallel rods attached to the pusher and slidably engaged in the slots for guiding the movement of the pusher towards and away from the blades.

9. A slicing device as set forth in claim 3 wherein a substantially concave pocket is provided in the pusher extending through the ribs whereby an object to be sliced is maintained in the central area of the pusher and towards the crossed junctions of the blades.

10. A slicing device as set forth in claim 1 wherein an auxiliary blade is provided below the crossed junctions of the blades closely adjacent the lower crossed edges, and removable mounting means secures the auxiliary blade below the junctions of the lower crossed edges of the blades whereby the slices of the object pushed through the blades are severed into two portions.

11. A slicing device as set forth in claim 10 wherein the movable connecting means comprises a pair of vertical slots in the mid-portions of the side plates, a pair of parallel rods is connected to the pusher which slidably engage within the slots, the slots herein inwardly disposed angularly extending portions and an auxiliary blade securing means comprising mounting rods engaging the angularly extended portions of the slots within the interior space.

12. A slicing device as set forth in claim 4 wherein the side and end plates each have uniform cross sections in at least one direction whereby their fabrication by extrusion is facilitated.

13. A slicing device as set forth in claim 12 wherein the pusher also has uniform cross sections in at least one direction whereby fabrication by extrusion is also facilitated.

14. A slicing device as set forth in claim 3 wheren the blades cross each other in a mid-portion of the interior space.

* * * * *